United States Patent [19]

Schliek et al.

[11] 4,059,044

[45] Nov. 22, 1977

[54] APPARATUS FOR FORMING AND TAKING AWAY PACKETS OF BAGS

[75] Inventors: Günter Schliek, Hendschiken, AG, Switzerland; Erwin Tirp, Lengerich, Germany

[73] Assignee: Windmoller & Holscher, Lengerich, Germany

[21] Appl. No.: 670,558

[22] Filed: Mar. 26, 1976

[30] Foreign Application Priority Data

Mar. 27, 1975 Germany ..... 2513776

[51] Int. Cl.[2] ..... F01B 19/00

[52] U.S. Cl. ..... 93/93 HT; 93/93 DP

[58] Field of Search ..... 93/93 HT, 93 R, 93 DP, 93/8 R

[56] References Cited

U.S. PATENT DOCUMENTS

| | | | |
|---|---|---|---|
| 2,228,887 | 1/1941 | Peterson | 93/93 DP X |
| 3,416,286 | 12/1968 | Ciccone | 93/93 DP X |
| 3,429,240 | 2/1969 | Kawai et al. | 93/93 DP |
| 3,631,770 | 1/1972 | Kratzert et al. | 93/93 DP |
| 3,643,557 | 2/1972 | Hayes | 93/93 DP |
| 3,748,973 | 7/1973 | Kuck | 93/93 DP |

*Primary Examiner*—Roy Lake
*Assistant Examiner*—Paul A. Bell
*Attorney, Agent, or Firm*—Fleit & Jacobson

[57] ABSTRACT

In apparatus for forming and taking away packets of bags deposited on a collecting table by a rotary depositing cylinder of a bag-making machine, the table extends substantially radially to the depositing cylinder, the packets of bags are successively withdrawn by gripper units which pass through the collecting table and take them away in a direction opposite to the direction of rotation of the depositing cylinder. Long and short holding fingers engage through recesses in the collecting table from beneath the latter and project beyond same, are movable longitudinally of the collecting table, can be flexed towards the depositing cylinder and have ends projecting away from the depositing cylinder periphery. The short holding fingers are mounted for reciprocating sliding motion substantially tangentially to the depositing cylinder between their retaining position and a lowered position below the plane of the collecting table. A control is provided which moves the short fingers to their holding position after the packet of bags has been taken away and descends again after the first few bags of the next packet have been collected.

5 Claims, 2 Drawing Figures

APPARATUS FOR FORMING AND TAKING AWAY PACKETS OF BAGS

The invention relates to an apparatus for forming and taking away packets of bags deposited by the rotary depositing cylinder of a bag-making machine, in which the bags are deposited on a stationary collecting table extending substantially radially to the depositing cylinder and the packets of bags are withdrawn and transported away in a direction opposite to the direction of rotation of the depositing cylinder by gripper units which pass through the plane of the collecting table and lift the packets of bags off the collecting table, comprising long and short holding fingers which engage through recesses of the collecting table from below, project beyond same, are movable longitudinally of the collecting table, can be flexed towards the depositing cylinder and the ends of which project away from the depositing cylinder periphery.

In an apparatus of this kind which is known from DT-PS 2 039 942 and which has on the whole proved satisfactory and operated substantially without problems, it has been found that the short holding fingers may displace individual bags of the packet as the packet is being taken away. Further, it may happen that the short holding fingers slide off the withdrawing packet so late that the first bag of the next following packet is not adequately held to the collecting table.

It is therefore an aim of the invention to improve an apparatus of the aforementioned kind so that no interruptions may be feared during formation and taking away of the packets of bags.

According to the invention, this aim is achieved in that the short holding fingers are mounted for reciprocating sliding motion substantially tangentially to the depositing cylinder between their retaining position and a lowered position below the plane of the collecting table, and a control is provided which moves them to their retaining position after commencement of taking away the collected packet and descends again after collection of the first bags of the new packet. By means of the apparatus according to the invention, the first bag of each new packet being formed is securely held to the collecting table and it is avoided that the bags in the packet can become displaced by the holding fingers.

In a further embodiment of the invention, provision is made for supporting bars that can be pressed onto the deposited bags at the level of the short holding fingers. The latter fix the packet being formed after the short holding fingers have been lowered.

Preferably, the short holding fingers are guided in guide sleeves, their control consisting of a latch cooperating with a tear-off cam. The tear-off cam may be driven by a rotary shaft, each rotation of the shaft corresponding to the formation of one stack.

Further, provision may be made for the supporting bars to be guided in a guide sleeve and loaded by a weight by way of a wire rope. In this way they will always be pressed against the packets of bags with a constant force and will always be ready for use.

An example of the invention will now be described in more detail with reference to the drawing, wherein.

Figure 1:
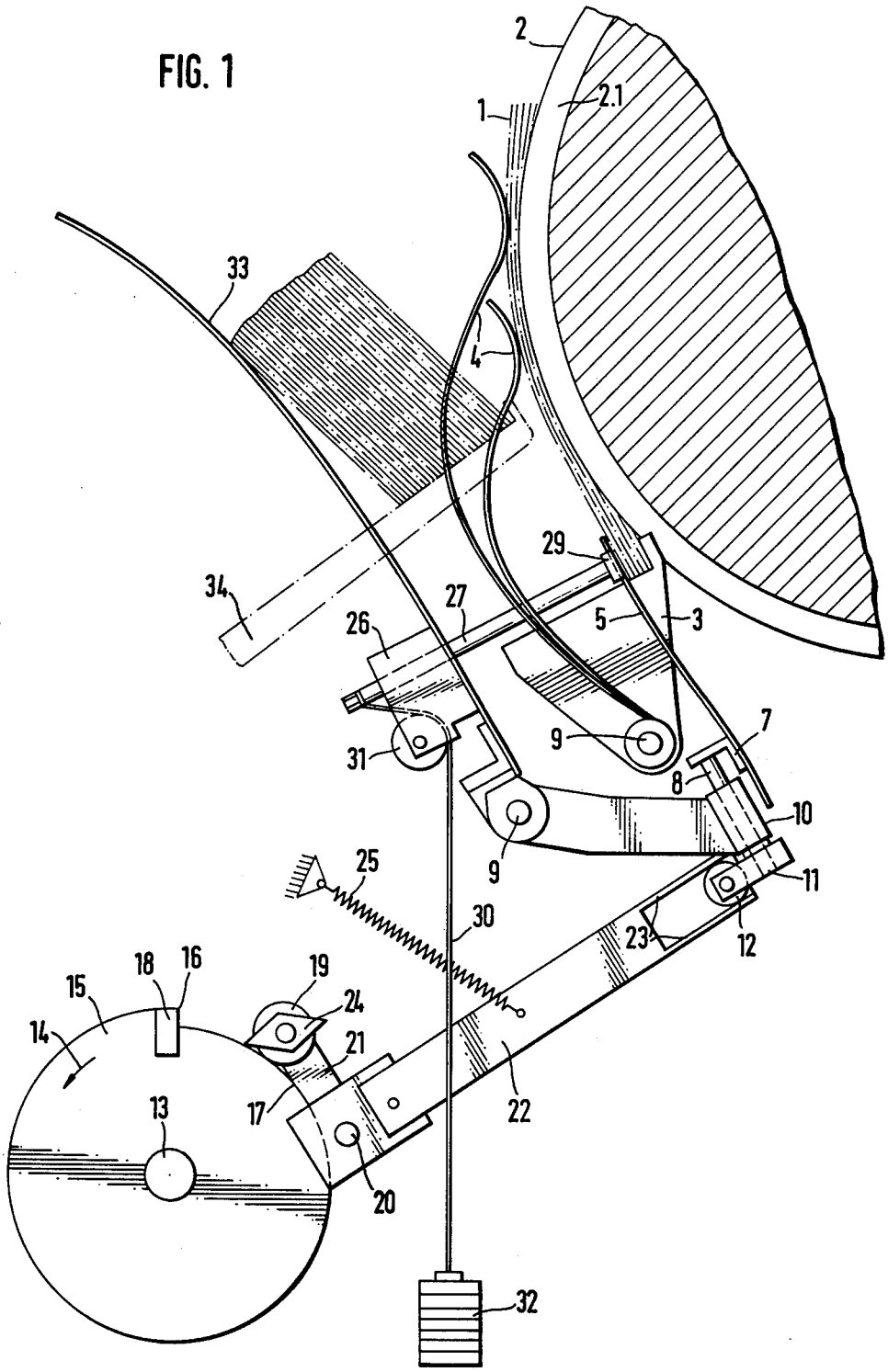
FIG. 1 is a diagrammatic side elevation of the apparatus.
Figure 2:
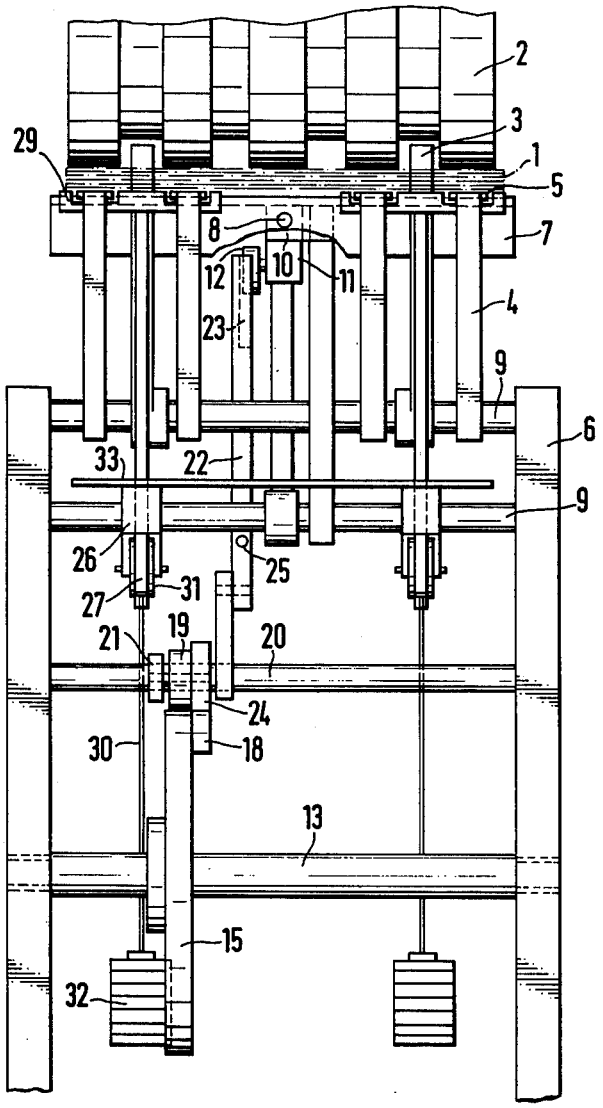
FIG. 2 is a plan view.

The bags 1 made by the bag-making machine are deposited in known manner by a depositing cylinder 2 on a depositing table which is fixed to the machine frame 6 and consists of a plurality of grid rods which project into grooves 2.1 of the depositing cylinder 2. Fixed to the depositing table 3 there are long holding fingers 4 formed by leaf springs. They engage from below through the spaces between the grid rods of the depositing table 3 and lie under slight spring pressure against the periphery of the depositing cylinder 2. The free ends of the holding fingers 4 are bent away from the bags 1 to be held thereby or from the periphery of the depositing cylinder 2 so that the bags 1 delivered by the depositing cylinder 2 will readily slip under the holding fingers 4 with their leading edges. Further, short holding fingers 5 are provided which project beyond the depositing table 3 by a smaller distance than the long holding fingers 4. They, too, are bent away at their free end. The holding fingers 5 are fixed to a cross-member 7 to which a guide pin 8 is also connected. A guide sleeve 10 disposed between the side walls of the frame 6 is fixed to cross-bars 9 and in it the guide pin 8 is mounted with a slide fit. Rigidly connected to the lower end of the guide pin 8 there is a supporting member 11 in which a roller 12 is rotatably mounted. Also rotatably mounted in the frame 6 there is a shaft 13 which is driven in the direction of the arrow 14 by the main drive of the machine, the drive not being shown. Fixed to the shaft 13 there is a cam plate 16 of which the characteristic cam contour is substantially circular but provided with a step 16. Between the step 16 and a point 17, the characteristic contour rises spirally and returns to a circular formation at the point 17. A wear-resistant member 18 is inserted in the cam plate 16 at the step 16 and is flush with the step 16. A roller 19 rolls on the cam plate 15 and is rotatably mounted on a short arm 21 of a double lever 21, 22 which is pivotable about a shaft 20 fixed to the frame. A guide 23 in which the roller 12 is guided is provided at the free end of the longer arm 22 of the double lever 21–22. Fixed to the short arm 21 of the double lever 21–22 there is a latch 24 which, after the roller 19 has rolled over the step 16, slides on a member 18 and at the step 16 onto the lower section of the cam plate 15 and jumping off of the latch 24 is effected by a spring 25 mounted on the longer arm 22, one end of the spring being fixed to the arm 22 and the other end to the frame 6.

Pins 27 are guided with a slide fit in guide sleeves 26 provided at the frame 6 of the machine. Supporting bars 29 are connected to the pins 27. These possess recesses for the short holding fingers 5. Wire ropes 30 passing over rollers 31 which are rotatably mounted in the frame 6 are fixed to the free ends of the pins 27 and carry weights 32. By reason of the weights 32, the supporting bars permanently lie against the stack of bags 1 accumulated on the depositing table 3.

The grippers which lift the stack of bags from the depositing table 3 and continue to convey them along a supporting plate 33 fixed with respect to the frame are designated 34.

The operation will now be described.

The cam plate 15 is so adjusted for movement of the grippers that, after the packet of bags has been lifted off the depositing table 3 by the grippers, the latch 24 jumps over the step 16 and the short holding fingers 5 are moved to the operating position. During continued transport of the packet of bags, the supporting bars 29 slide off the lower edge of the packet of bags and come to lie on the new packet of bags. In the meantime, the cam plate 15 has turned until the roller 19 has reached the point 17 of the cam plate 15 and the short holding fingers 5 have thus been returned by the cam plate 15 to below the depositing table 3. The bags 1 are now held only by the supporting bars 29. The short holding fingers 5 remain in this waiting position until the stack of bags is lifted off by the grippers. The above described cycle is then repeated.

We claim:

1. Apparatus for forming and taking away packets of bags deposited by a rotary depositing cylinder of a bag-making machine, in which the bags are deposited on a stationary collecting table extending substantially radially to the depositing cylinder and the packets of bags are withdrawn and transported away in a direction opposite to the direction of rotation of the depositing cylinder by gripper units which pass through the plane of the collecting table and lift the packets of bags off the collecting table, wherein the improvement comprises long and short holding fingers each having one end positioned below the collecting table, said holding fingers extending through recesses of the collecting table from below and projecting beyond the collecting table, the other end of said long holding fingers projecting away from the depositing cylinder periphery, said holding fingers being flexible so they can move longitudinally of the collecting table, and can be flexed towards the depositing cylinder, mounting means for mounting said short holding fingers for reciprocating sliding motion substantially tangentially to the depositing cylinder between a retaining position where said short holding fingers retain bags on the depositing cylinder and a lowered position below the plane of the collecting table, control means for moving said short holding fingers substantially tangentially to the depositing cylinder to the retaining position after the lifting of an entire packet of bags by the gripper unit has commenced, and to the lowered position after collection of the first bags a new packet.

2. Apparatus according to claim 1 further comprising supporting bars, pressing means for pressing said supporting bars onto the deposited bags adjacent the short holding fingers.

3. Apparatus according to claim 1 wherein said mounting means comprises guide sleeves, and guiding means for guiding said short holding fingers within said guide sleeves, said control means comprising a latch co-operating with a tear-off cam.

4. Apparatus according to claim 3, wherein said tear-off cam is driven by a rotary shaft.

5. Apparatus according to claim 2 wherein said pressing means comprises a guide sleeve, means for guiding said supporting bars within said guide sleeve, a wire rope means connected to a weight at one end and to said means for guiding at its other end for biassing said supporting bars toward the depositing cylinder.

* * * * *